US005181322A

United States Patent [19]

Koo

[11] Patent Number: 5,181,322

[45] Date of Patent: Jan. 26, 1993

[54] CAN OPENERS

[75] Inventor: Vincent H. Koo, Hong Kong, Hong Kong

[73] Assignee: Maxpat Trading & Marketing (Far West) Limited, Hong Kong, Hong Kong

[21] Appl. No.: 681,549

[22] PCT Filed: Nov. 6, 1989

[86] PCT No.: PCT/GB89/01323

§ 371 Date: May 7, 1991

§ 102(e) Date: May 7, 1991

[87] PCT Pub. No.: WO90/05108

PCT Pub. Date: May 17, 1990

[51] Int. Cl.[5] ..... B67B 7/00; B67B 7/14; B67B 7/24; B67B 7/32

[52] U.S. Cl. ..... 30/416; 30/421; 30/426; 30/427

[58] Field of Search ..... 30/416, 417, 418, 419, 30/421, 422, 424, 425, 427, 426; 173/109

[56] References Cited

U.S. PATENT DOCUMENTS

| | | | |
|---|---|---|---|
| Re. 27,504 | 9/1961 | Smith | 30/422 |
| 2,196,182 | 4/1940 | Arnesen | 30/427 |
| 2,255,641 | 9/1941 | Arnesen | 30/427 |
| 4,251,917 | 2/1981 | Peres | 30/421 |
| 4,641,714 | 2/1987 | Ferioli | 173/109 |
| 4,733,472 | 3/1988 | Belcourt | 30/425 |
| 4,734,986 | 4/1988 | Peters | 30/426 |
| 4,782,594 | 11/1988 | Porucznik et al. | 30/422 |

*Primary Examiner*—Douglas D. Watts
*Assistant Examiner*—Paul M. Heyrana, Sr.
*Attorney, Agent, or Firm*—Townsend and Townsend

[57] ABSTRACT

A can opener of the type in which the can is opened by cutting through an outer part of the rim joining the lid with the main body of the can. Cam means (51) are arranged to engage outside wall of the can immediately beneath the rim, the engagement underneath the rim moving the cam means and cutter wheel (40) against resilient means (54) to a position such that the cutter wheel makes its cut at a substantially constant predetermined distance on the rim. The drive wheel can have an outer cylindrical surface which is toothed and its lower edge bevelled or chamfered. To reduce friction, the shaft supporting the drive wheel may be journaled within a metal sleeve supported by the body of the can opener, the outer surface of the shaft and the inner surface of the sleeve mate at positions adjacent the ends of the sleeve so as to provide good rotational support for the shaft and intermediate those positions a gap being provided between the outer surface of the shaft and the inner surface of the sleeve to avoid contact between the shaft and sleeve. The cutter wheel may be supported by an arcuate support wall (66) during cutting.

16 Claims, 7 Drawing Sheets 32
64
16
74
72
65
14
18
66
40
26
78
76
10

70
12
14
65
80
82
86
18
A
7
3
26
10
76
78
32

CAN OPENERS

This invention relates to can openers. In particular the invention relates to a can opener of the type which will remove the lid of a can by making a cut through the outer part of the join between the lid and the wall of the can.

An example of such a can opener is shown in U.S. Pat. No. 4,734,986 to which reference is directed. The can opener shown in that Patent makes a thin cut around the rim through the material of the lid itself where it is folded over and around the top of the upright wall of the can. The lid is then removed from the rest of the can by means of a gripping mechanism which levers the lid from the remainder of the can.

Such a can opener has a number of advantages over existing can openers in that the remaining top edge of the opened can is not sharp. Thus what is in fact exposed is the turned over top edge of the side wall of the can and that is smooth and so unlikely to cut a user who may hold it or touch it. Also the top edge is still well reinforced by the remaining folded-over material of the can and so, when the can is gripped, it still retains it's shape. Further, since the cut takes place only on the outside of the can wall and there is no penetration through into the interior of the can, no metal filings or the like will contaminate the contents of the can and the possibly unhygienic cutting knife does not contact the contents of the can.

As explained in the above noted Patent, there are problems in providing the necessary close tolerances in the construction of the can opener and in maintaining them during a cutting operation and the above Patent aims to provide one way of achieving this. Good results can be achieved with can openers according to this Patent but the results arc not always consistent.

There are a wide range of shapes and sizes of can on the market, and we have found that there are large differences in the dimensions of the folded over seam joining the lid to the rest of the can. The can opener shown in the above noted Patent does not provide a way of dealing with these differences.

It is therefore an object of the present invention in one aspect to achieve this.

According to the invention in one aspect there is provided a can opener for opening a can having a lid joined to a main body by a rim, in which the can is opened by cutting through an outer part of the rim joining the lid with the main body of the can, in which the can opener comprises a rotatably supported cutter wheel for engaging and cutting the said outer part of the rim, a rotatable drive wheel for engaging the inner part of the rim, means for gripping the rim between the cutter wheel and drive wheel so that, upon rotation of the drive wheel, the can opener orbits around the rim of the can and the cutter wheel can complete a cut around the outer part of the rim, resilient means for allowing the cutter wheel to move resiliently in an axial direction along its axis of rotation, and cam means joined to the cutter wheel and axially spaced from the cutter wheel by a predetermined amount, the cam means being arranged to engage the, underside of the rim, the engagement underneath the rim moving the cam means and the cutter wheel against the resilient means to a position such that the cutter wheel makes its cut at a substantially constant predetermined distance up the rim from its lower end.

We find that with such a can opener a consistent good result can be achieved since, irrespective of the shape and size of the can or of the size and depth of the rim, a cut can be achieved in the best position for lid removal. In practice, or example, we have measured the depth of the rim in a wide variety of commercially available cans and have found that this depth can vary from about 2.5 mm to about 3.5 mm, and is not by any means consistent from one can of the same product to another. This problem is avoided by the invention, however, since the cam means will engage under the rim and if necessary move the cutter wheel against the resilient means to a set position above the lower edge of the rim. Further, if there is any variation in the rim depth as the opener orbits around the can, this will also be accommodated.

In one preferred embodiment of the invention the cam means comprise a circular flange having an upper face which is slightly inclined relative a plane radial to the axis of the flange and is arranged to engage under the rim, the inclined upper face moving the circular flange and the associated cutter wheel against the resilient means as the flange is forced in beneath the rim when the rim is gripped between the cutter wheel and drive wheel and the cutting edge of the cutter wheel is forced to penetrate through the outer part of the rim. The circular flange has a larger diameter than the cutter wheel since it engages the upright wall of the main body of the can which is of necessity of smaller diameter than the rim. The difference in diameters can, however, be chosen to ensure that the cutting edge of the cutter wheel does not penetrate significantly beyond the material of the outer par of the rim.

The circular flange and cutter wheel can be formed from a single piece of material or could be made separately and then joined so that they will rotate together and move together longitudinally of their rotational axis. Conveniently, they are jointly mounted about a common axle on which they rotate.

The resilient means can, in one simple embodiment of the invention, comprise a resilient rubber washer mounted between the cam means and a stationary support. Thus, as the cam means move the cutter wheel down to fit the can means beneath a rim, that washer will be compressed, and when a cutting operation is over then the compressed washer will restore the cutter wheel to its rest position along its rotational axis.

As explained in the above noted United States Patent, there are problems in providing the necessary close tolerances in the support of the cutting knife of the can opener and the Patent aims to provide one way of achieving this. We have found, however, that to accommodate different types of tin, the cutting knife cannot be supported in the way defined in that Patent. However the cutting knife still needs good support and it is, therefore, an object of another aspect of the present invention to achieve this.

According to another aspect of the invention there is provided a can opener for opening a can having a lid joined to a main body by a rim, in which the can is opened by cutting through an outer part of the rim joining the lid with the main body of the can, in which the can opener comprises a cutter wheel for engaging and cutting the said outer part of the rim, a rotatable drive wheel for engaging the inner part of the rim, a pair of body members pivoted to one another and arranged, upon pivoting relative one another, to move the drive wheel and cutter wheel towards and away from one another respectively to allow the can opener to be fitted over the rim of a can to be opened and to grip the rim between the cutter wheel and drive wheel so that, upon rotation of the drive wheel, the can opener orbits around the rim of the can and the cutter wheel can complete a cut around the outer part of the rim, the cutter wheel being rotatably supported on a shaft upstanding from one of the body members, a circular flange of diameter greater than the cutter wheel also being supported on the said shaft, and an arcuate support wall upstanding from the said one body member and being centered on the axis of rotation of the cutter wheel, the circular flange being arranged to bear against the support wall to assist in supporting the shaft and cutter wheel during cutting of the rim of a can.

We have found that with such an arrangement the rotational axis of the cutter wheel can be maintained accurately even under high cutting loads. Generally the body members will be made of synthetic plastics material and so the axis of tho shaft, which may be integrally formed with the said one body member or may be a separately member, will be liable to distort under load because the plastics material of the said body member will be incapable of resisting this distortion. It is undesirable that this occurs since then the required close cutting tolerances will be lost, but this distortion is kept to a minimal level by the support given to the shaft. Thus, the arcuate support wall buttresses the circular flange mounted on the shaft and so helps to prevent bending of the shaft under load, particularly if the circular flange is mounted outwardly of the cutting edge.

In addition we have found that it can be desirable for the two pivoted body members to have at least one cooperating flange and recess the such that engagement of the flange in the recess reinforces the said one body member by the other. This reinforcement of one body member by the other using the flange and recess arrangement reduces the chance of an overall distortion of the said one body member provided with the shaft and the arcuate support wall.

In one embodiment the body members have integral handles extending generally away from the axis of pivoting of the two body members. Then, at the edge of at least one handle where it abuts tho other body member, there may be provided a recess into which a corresponding arcuate shaped flange of the other handle fits. It is preferred that a pair of cooperating flanges and recesses be provided. Thus the edge of each handle where it abuts the other body member, may have a flange extending into engagement with a corresponding recess in the other body member.

We have found that it is of importance that there be close tolerances in the positioning of the cutting knife on a can to be opened and it is, therefore, an object of another aspect of the invention to achieve this.

According to another aspect of the invention there is provided a can opener for opening a can having a lid joined to a main body by a rim, in which the can is opened by cutting through an outer part of the rim joining the lid with the main body of the can, in which the can opener comprises a cutter wheel for engaging and cutting the said outer part of the rim, a rotatable drive wheel for engaging the inner part of the rim, a pair of body members pivoted to one another and having integral handles extending generally in a direction away from the axis of pivoting, the body members being arranged, upon pivoting relative one another, to move the drive wheel and cutter wheel towards and away from one another respectively to allow the can opener to be fitted over the rim of a can to be opened and to grip the rim between the cutter wheel and drive wheel so that, upon rotation of the drive wheel, the can opener orbits around the rim of the can and the cutter wheel can complete a cut around the outer part of the rim, one body member supporting the cutter wheel and having a substantially flat surface in the region of the nip between the cutter wheel and the drive wheel, the integral handle of the other body member having an undersurface which is substantially flat and also substantially in the same plane as the substantially flat surface on the said one body member, whereby when the body members and their integral handles are pivoted to allow the can opener to be fitted over the rim of a can, those two surfaces will rest on the top of the rim of a can and will align the axis of the cutter wheel so that at least in the plane containing them it is parallel with the upright axis to the can.

This has the advantage that the circular cutting edge on the cutting wheel will be accurately aligned in the direction of the cut to be made and ensures that, as the body members and their handles are pivoted together to bring the drive wheel and cutter wheel close together to grip the rim, the initial penetration of the rim by the cutting edge will be accurately aligned in the desired direction of the cut to be made. As a result an improved consistency of cutting from one can to another can be achieved.

It is preferred that the said one body member which supports the cutter wheel also have a further contact surface on the opposite side of the drive wheel from the cutter wheel. This contact surface should be spaced downwardly from the said substantially flat surface on the said one body member by an amount substantially equal to the inner depth of the rim, that is to say the height of the rim above the central top region of the lid. Thus, this further contact surface will rest on the top of the lid and ensure that the axis to the cutter wheel is also aligned so as to parallel with the upright axis of the can in a direction transverse to a plane containing them. In effect with this additional contact surface there is a three point contact with the can when the body members are pivoted to their open position and the can opener placed over the rim of a can to opened which guides the user so that, as the handles are closed, the cutter wheel is kept in correct alignment to penetrate the rim.

We have also found that can openers of the type shown in the above United States Patent have difficulty in coping with cans having small radius corners. The problem seems to be that the drive wheel which drives the opener around the can slips and fails to moves the can opener.

Therefore in accordance with one embodiment of the invention the drive wheel has an outer cylindrical surface which is serrated to allow it to grip into the material of the rim to assist in driving the can opener around the can, and the lower edge, that is to say the edge adjacent to the lid of the can when in use, of the outer cylindrical surface of the drive wheel is bevelled.

By providing this bevel we have surprisingly found that a more reliable drive action is achieved even through the effect of the bevel is actually to reduce the area of contact between the drive wheel and the rim of the can. In particular it seems that in tight corners of a can, the rim is often distorted and not upright so that with a drive wheel having a completely cylindrical outer face only a line contact is achieved anyhow whereas with a can opener according to this aspect of the invention a much larger area of contact can be achieved between the drive wheel and the rim of the can in tight radius corners.

Additionally we have found that it is desirable to keep the tolerances of the depth of the cut made very close to the desired amount so that the cutter wheel does not penetrate into the rim significantly further than the outer layer of material. Further the gripping force between the cutter wheel and drive wheel should desirably not distort the rim of the can. The bevel also has the advantage of ensuring that the outer peripheral surface of the drive wheel can fit closely to the inner face of the rim without significantly distorting the rim.

The angle of the bevel is preferably about 45° but could, for example, range from 30° to 60° to the axis of the drive wheel. Preferably also the bevel extends radially at least equal to the depth of the serrations.

We have also found that it is desirable that the serrations in the drive wheel be relatively shallow since if the serrations are too large they are liable to bite into the rim of the can and damage it and lock the layers of the rim together, with the result that it may not be easy to lever off the severed lid. Preferably therefore the maximum radial depth of the teeth or serrations is no more than 1.5 mm and most preferably the radial depth is no more than 1 mm. Generally speaking therefore there will be a relatively large number of shallow, closely spaced serrations.

Another problem we have encountered with can openers of this type is that the forces required to make the cut and advance the can opener around the top of the can tend to be quito high. Therefore anything one can do to reduce the effort required is clearly highly desirable.

Generally speaking the main body of the can opener itself is made of synthetic plastics material whilst the shaft carrying the driving gear is made of metal and usually steel. As a result there are relatively high friction forces between the shaft and the body of the plastics material and it is an object of a further aspect of the invention to overcome this.

According to a further aspect of the invention there is provided a can opener of the type which opens the can by making a cut from the outside through the outer layer of material of the rim and which has a drive wheel which engages the inside of the rim around the can lid and upon rotation drives the can opener around the can, and in which the drive wheel is supported by a metal shaft which is rotatably journaled within a metal sleeve supported by the body of the can opener, the outer surface of the shaft and the inner surface of the sleeve mate at positions adjacent the ends of the sleeve so as to provide rotational support for the shaft and intermediate those positions a gap being provided between the outer surface of the shaft and the inner surface of the sleeve to avoid contact between the shaft and sleeve so as to reduce frictional forces upon rotation of the shaft relative the sleeve.

With such an arrangement the frictional forces between the two parts of the metal shaft which engage the sleeve and the sleeve itself are kept quite small and unnecessary frictional forces are avoided by providing the gap between the central portion of the shaft and the sleeve so that there is no frictional force at all. Thus, it is not necessary for that central portion to contact the sleeve to provide good rotational support provided the ends of the sleeve mate with the shaft. In addition, the resulting recess which is formed between the interior surface of the sleeve and the outer surface of the shaft can be filled with a lubricant such as a grease to reduce frictional contact in the mating regions.

The interior surface of the sleeve and external surface of the shaft are preferably of hardened steel so as to ensure that frictional forces are kept to a minimum. For example, they should be hardened and tempered to a specification according to Rockwell Hardness C scale (HRC) within the range of 45 to 56.

According to one simple embodiment of this aspect of the invention, the sleeve is of constant internal cross-sectional diameter whilst the shaft has a region of reduced diameter between the areas of intended contact with the sleeve so as to provide the said gap.

The invention will now be illustrated, by way of example, with reference to the accompanying drawings, in which.

Figure 1:
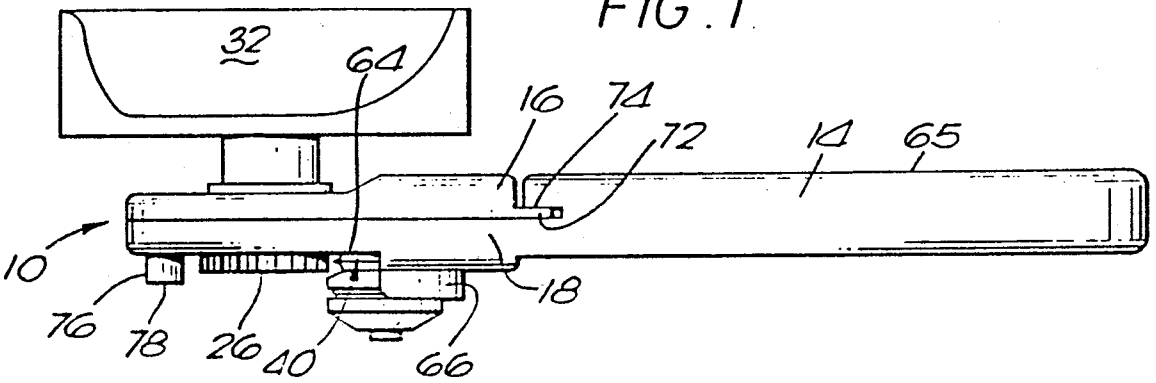
FIG. 1 is a side elevation of one form of can opener according to the invention.

The can opener 10 shown in FIGS. 1 to 10 of the drawings comprises a pair of handles 12 and 14 which are integrally formed with body portions 16 and 18, respectively. The latter are pivoted to one another about a spigot 20 (FIG. 3) which is integral with the body portion 16 and which extends into a corresponding opening in the body portion 18.

A spindle 24 passes through the spigot 20, the spindle being formed at one side with a drive wheel 26. This has on its outer face, serrations, teeth or the like to allow it to grip the inside of a can rim 29 so that, when it is rotated, it will drive the can opener 10 around a can 30 to be opened. At its other side, the spindle is joined to a crank 32 by means of which the wheel 26 can be manually rotated.

Figure 2:
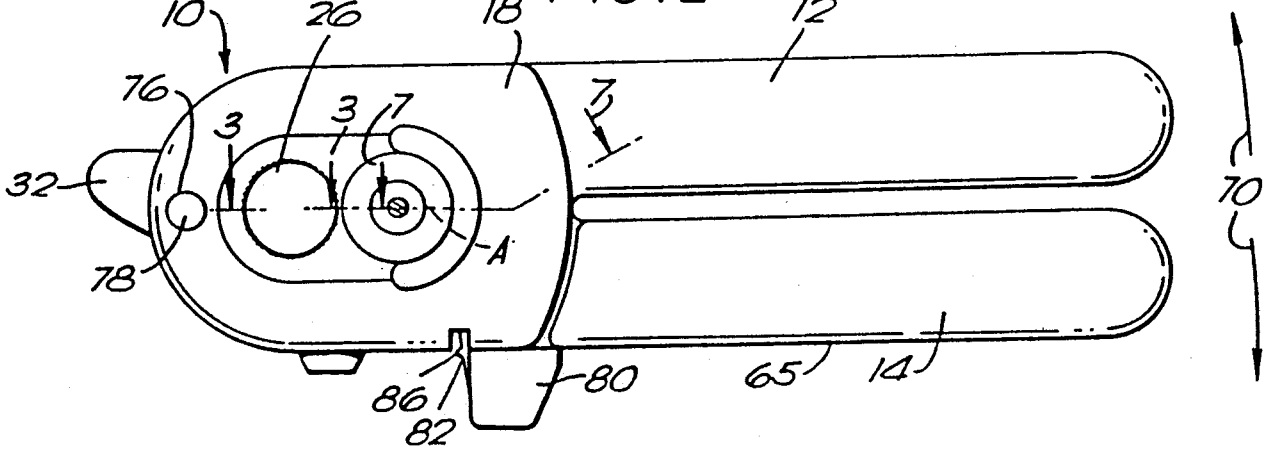
FIG. 2 is an underneath view.
Figure 3:
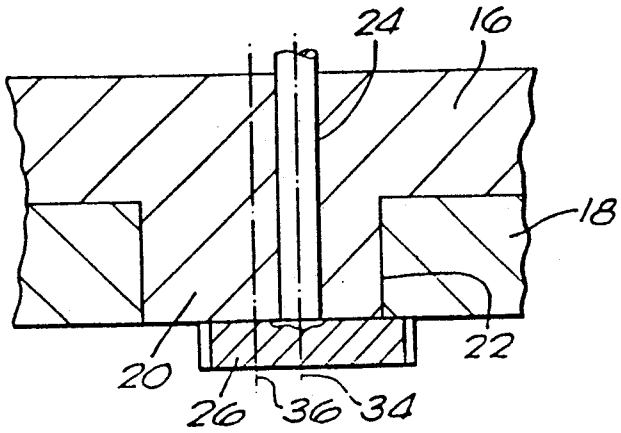
FIG. 3 is an enlarged cross-sectional detail taken along the line 3—3 of FIG. 2.

As best seen in FIG. 3, the axis 34 of the spindle 24 is offset from the axis 36 of the spigot 20. In this way, when the handles 12 and 14 are opened up to the position shown in FIG. 8 by pivoting the portions 16 and 18 about the spigot 20, the drive wheel 26 is moved away from a cutter wheel 40 and so can be placed over the rim 29 of a can to be opened, and conversely, when the handles are brought together as shown in FIG. 2 and grasped in the hand of a user, the drive wheel 26 is moved in closer to the cutter wheel 40 so that the rim 29 of the can is gripped between the two.

Integrally formed with the body portion 18 is an upstanding shaft 44 (FIGS. 6 and 7) on which the cutter wheel 40 is idly and rotatably mounted. The cutter wheel comprises a circular cutting edge 46 and an integral circular flange 48. The outer cylindrical face 49 of this is of slightly larger diameter than the cutting edge 46 so that the face 49 can bear against an upright side wall 50 of the can 30. The flange also has a slightly inclined cam edge 51 formed on its upper face which is designed to engage below the rim 29 of a can. This edge 51 is angled at about 80° to the axis of rotation of the cutter wheel. It could however be angled say from 75° to 85° to the axis of rotation. It is, however important that the edge 51 penetrate under the rim 29 which will normally be 1 to 1.5 mm larger in diameter than the side wall 50 and move the cutter wheel 40 is required as explained below.

The cutter wheel 40 is held in place on the shaft 44 by an end cap 52 riveted or screwed to the shaft 44. However, between the end cap 52 and the wheel 40 is a resilient washer 54 of elastomeric material, and in turn between the washer 54 and the wheel 40 is a thin metal washer 55.

Figure 5:
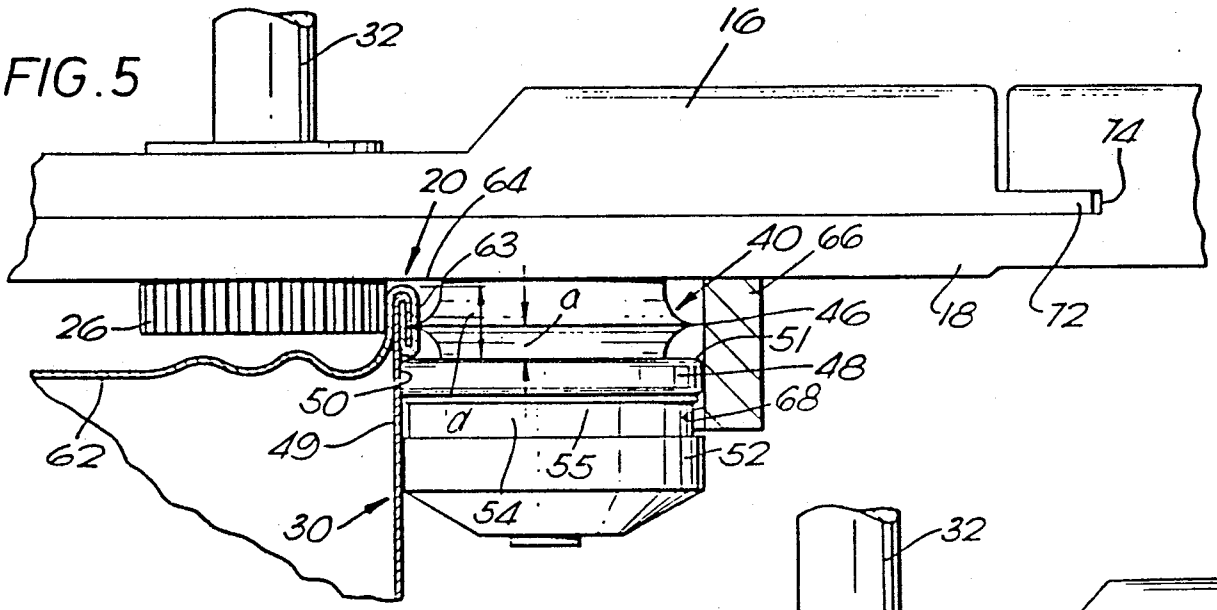
FIG. 5 is an enlarged detail of the area circled in FIG. 4 and marked 5 in the case of one can.

Referring to FIG. 5, this shows in detail the construction of the rim 29 of a can 30. The top of the side wall 50 of a can is bent over in the shape of a "U" whilst the edge of a lid 62 is bent up around the inside of the side wall, over the top of the bent-over side wall, down around the outside of that bent-over portion in a region 63 and finally its end is bent up inside and so trapped by the bent-over top of the side wall. In a can opener of the invention it is the bent-over portion of the lid 62 in the region 63 which is cut by the cutting edge 46.

Figure 4:
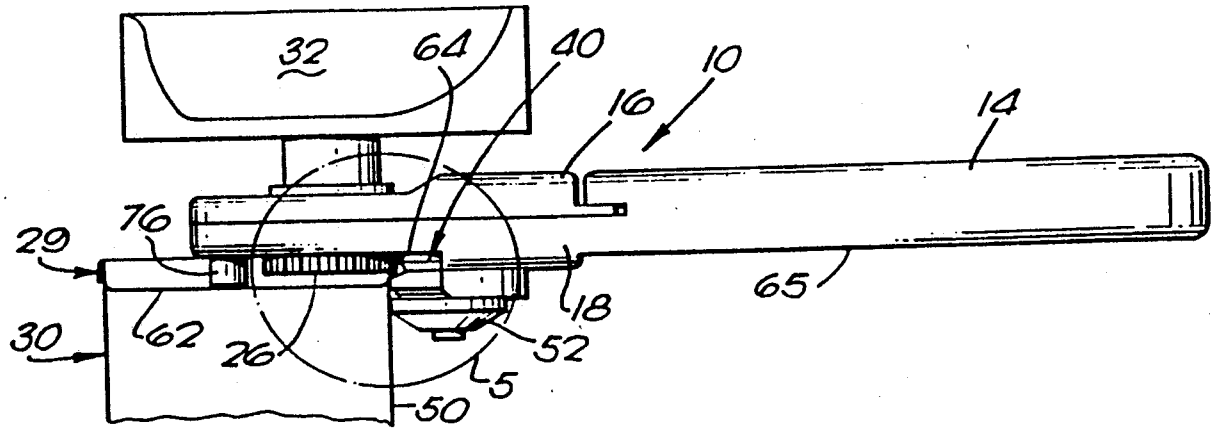
FIG. 4 is a side view showing the can opener in use on the first step of opening a can.

The surface 64 of the body portion 18 between the cutter wheel 40 and drive wheel 26 is flat and transverse to the axis of the rotation of the two wheels. In addition and as best seen in FIGS. 1 and 4 the undersurface 65 of the handle 14 is in the same plane as that surface 64. Therefore when the body portions and their respective handles are pivoted open to enable a can rim 29 to enter between the drive wheel 26 and cutter wheel 40, the top of the rim 29 can rest on the surface 64. Because this is flat right across the width of the body portion 16 the resting of the surface on the rim will align the axis 45 with the upright axis of the can. In addition with the handles 12 and 14 opened up as in FIG. 8 or even further than that, the surface 65 can additionally rest on the rim 29 (shown diagrammatically by the broken line 29 in FIG. 8) and assist in ensuring this alignment.

At the outer end of the body member as formed an integral downwardly extending lug 76 having a lower flat contact surface 78. This extends downwardly by an amount approximately equal to the height of the rim 28 above the top surface of the lid 62. In this way, by resting the contact surface 76 on the lid 62 when the can opener is placed over the rim 29 of a can to be opened, one can ensure that the axis 45 of rotation of the cutter wheel 40 is accurately parallel to the upright axis of the can.

Figure 8:
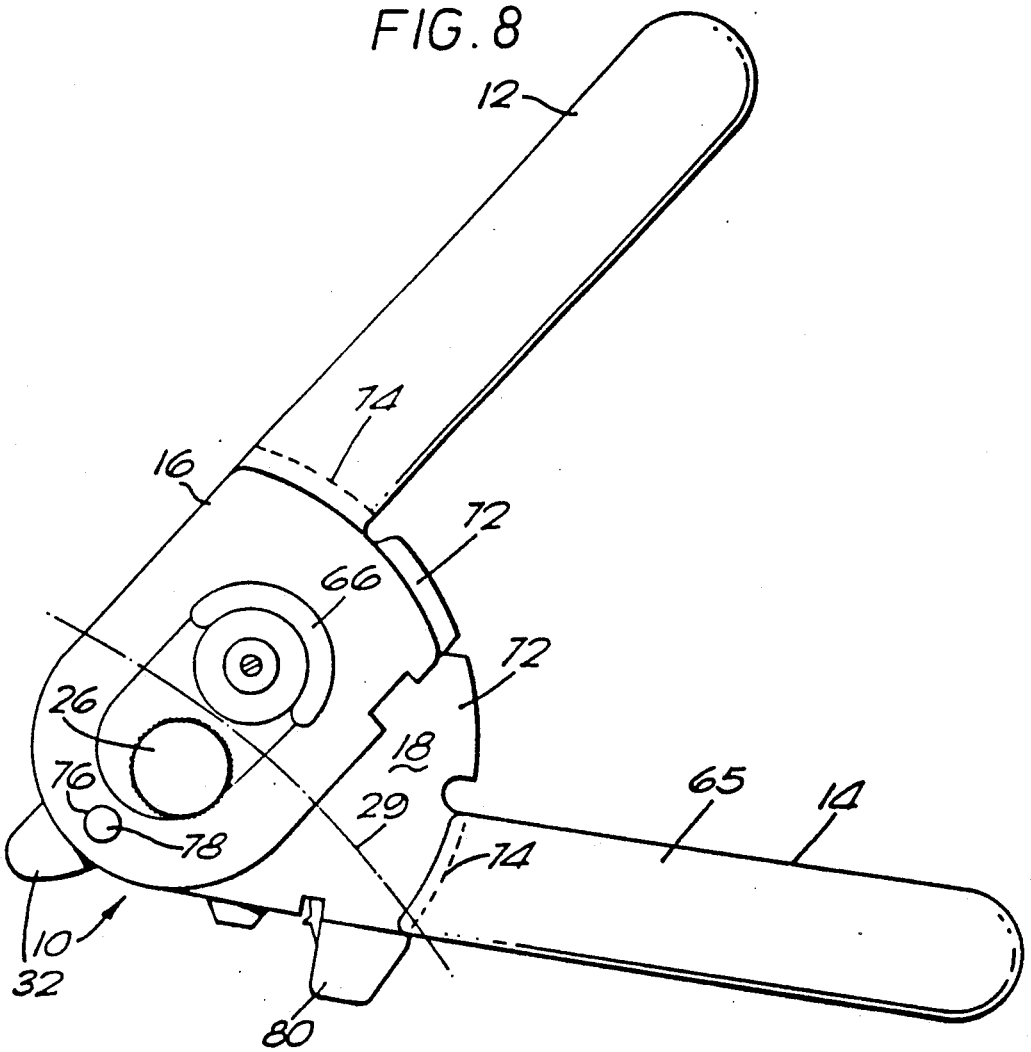
FIG. 8 is an underneath view showing the can opener in the opened position.

In the removal of the lid 62, the handles 12 and 14 are first of all opened up by pivoting them apart in the direction of the arrows 70 (FIG. 2) to the position shown in FIG. 8. This opens up a gap between the drive wheel 26 and the cutter wheel 40 as has been described. The can opener can then be placed over the top of a can 30 with the rim 29 between the wheels 26 and 40. The handles are then brought to their closed position as shown in FIG. 2. The handles are then brought to their closed position as shown in FIG. 2. This causes the rim 29 to be gripped between the wheels 26 and 40 and the teeth or serrations 27 of the drive wheel engage tightly with the inside of the rim 29. At the same time, the cutting edge 46 is forced through the material of the lid in the region 63.

As has been explained above the surface 64 and 65 ensure that the cutting edge 46 is accurately aligned in the direction around the rim 29 in which the circular cut is to be made. Also, the contact of the contact surface 78 with the top of the lid 62 ensures that the cutting edge 46 enters the material of the lid precisely in a direction at right angles to the upright side wall 60 of a can.

Next the crank 32 is rotated whilst the user grips the handles 12 and 14 with his other hand. The rotation causes the can opener 10 to orbit around the can and make a complete circular cut through the material of the lid in the region 63.

It will be seen best from FIG. 5 that, when the handles are fully closed, the edge 51 of the flange 48 has engaged under the lower edge of the rim 29, the cylindrical outer face 49 of the flange 48 contacting the outer face of the side wall 50 of the can. The depth d of a rim 29 varies widely from can to can and may even vary around an individual can. This can lead to inconsistent cutting and so as to avoid this it will be seen that, if the depth d is greater than the minimum envisaged in FIG. 5, i.e. the situation in FIG. 6, then the cam surface 51 still engages under the lower edge of the rim 29 but draws the cutter wheel 40 downwardly, so compressing the washer 54. The spacing a between the cutting edge 46 and the lower edge of the rim 29 remains constant and is of course fixed by the relative positions of the flange 48 and cutting edge 46. Consistent cutting results can therefore be achieved.

Once a complete circular cut has been made, the handles 12 and 14 arc opened up and the can released. At the same time, the washer 54 will restore the cutter wheel to its position shown in FIG. 5 if it was moved away from this in the sense shown in FIG. 6.

Integrally formed with the body member 18 is an upstanding arcuate wall 66. Its axis is centered on the axis of the shaft 44, and it extends angularly for approximately 180°, half and half on either side of a line A (see FIG. 2) which is an extension of a line joining the axes of the cutter wheel 40 and drive wheel 26 when the can opener is in the position shown in FIG. 2. The wall 66 could extend angularly for more or less, e.g. from about 45° to about 220°, half and half on either side of the line A. In practice if it extends for more than 180° this can lead to difficulties in assembling the can opener whereas 180° is a preferred extent so that the wall not only supports the shaft to prevent bending away in the sense of direct line between the axes of the cutter wheel and drive wheel but also supports the shaft to prevent sideways bending as the can opener makes a cut.

Figure 6:
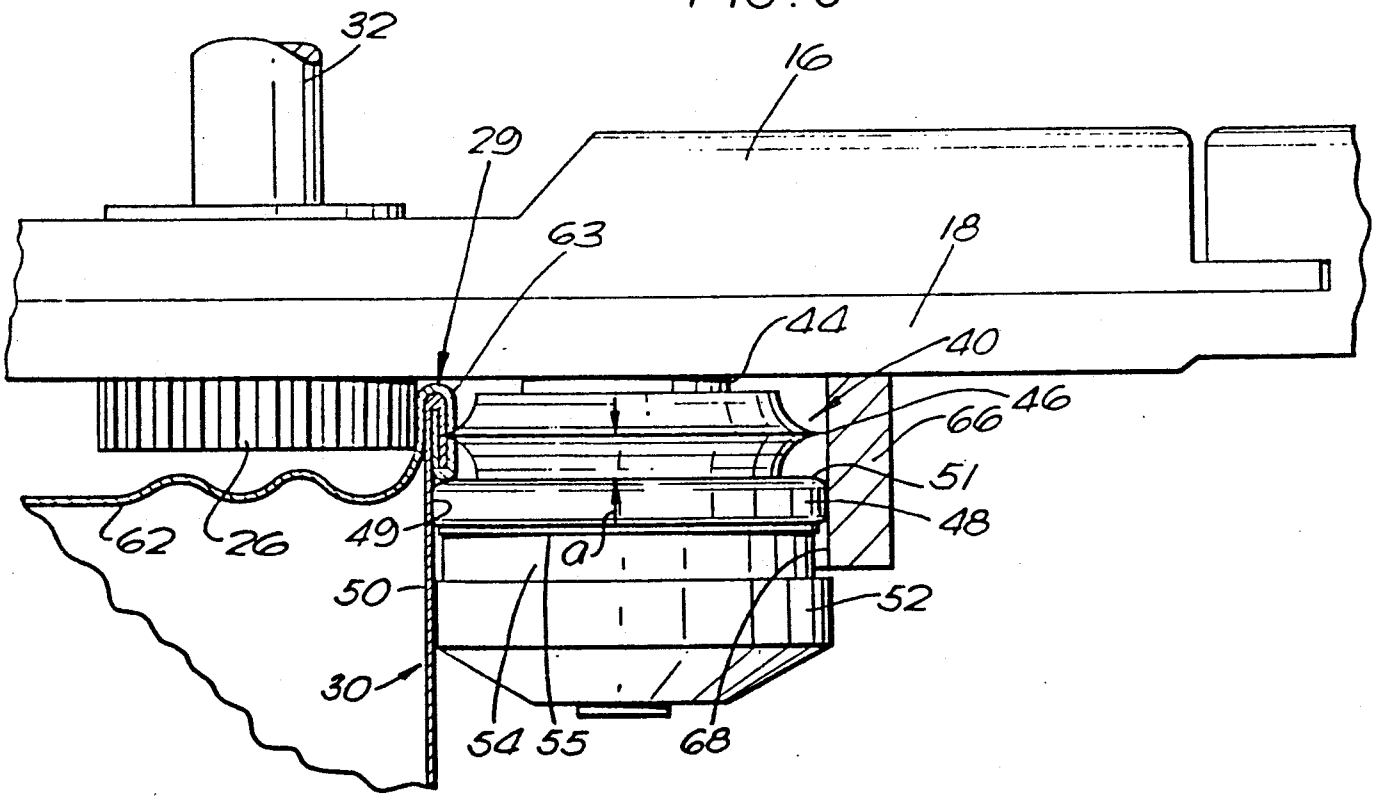
FIG. 6 is an enlarged detail similar to FIG. 5 but showing the case of a different can.
Figure 7:
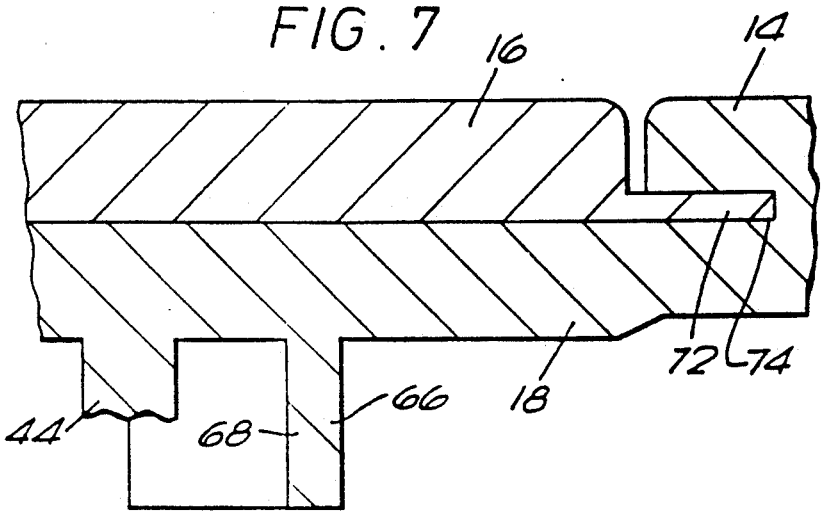
FIG. 7 is an enlarged cross-sectional detail taken along the line 7—7 of FIG. 2.

As best shown in FIGS. 5 and 6, the inside face 68 of the wall has a diameter approximately the same as that of the outer cylindrical face 49 of the flange 48. That face 49, therefore, contacts the face 68 and in this way the wall can buttress the shaft 44 during a cutting operation, so preventing substantial distortion of the shaft 44 and consequently misalignment of the cutting edge 46 with the rim 28. This is despite the fact that the body member 18 and its integral shaft 44 are moulded from synthetic plastics material.

To further enhance the stiffness of the arrangement, each body member 16 and 18 may be provided along its edge with an integral arcuate flange 72 which extends into a corresponding shaped slot 74 on the edge of the handle 12 or 14 of the other body member. Thus the flanges 72 can slide easily within their respective slots 74 as the handles and body members arc pivoted. However, when the can opener is in a position for making a cut, i.e. the position shown in FIG. 2, the flanges 72 are wholly received in their respective slot 74 and the body members 16 and 18 then buttress and reinforce one another to prevent twisting and bending of the members when under a can opening load. Again this assists in keeping the cutting edge 46 in the required close tolerances for accurate and consistent can opening.

Upon removal of the can opener 10 the lid 62 will still appear to be intact on the can. It can be removed by levering it off using a mechanism 80, which as best shown in FIG. 2, is provided on one side of the body portion 8.

Figure 9:
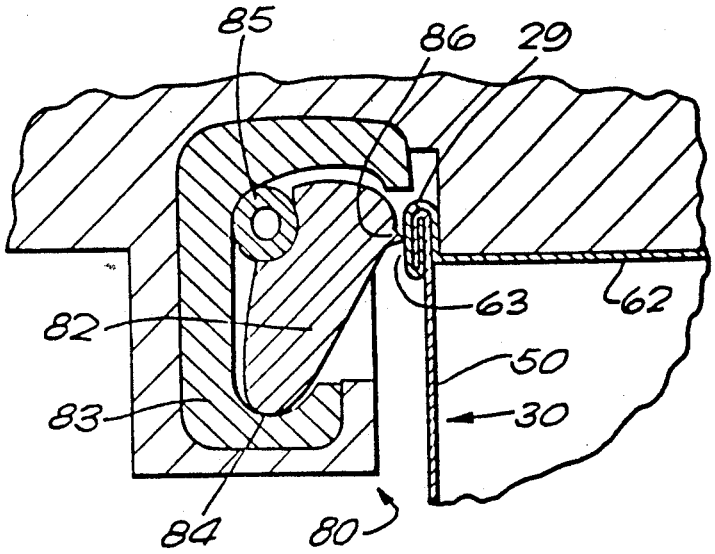
FIG. 9 is an enlarged cross-sectional detail showing the second step in the removal of the can lid.
Figure 10:
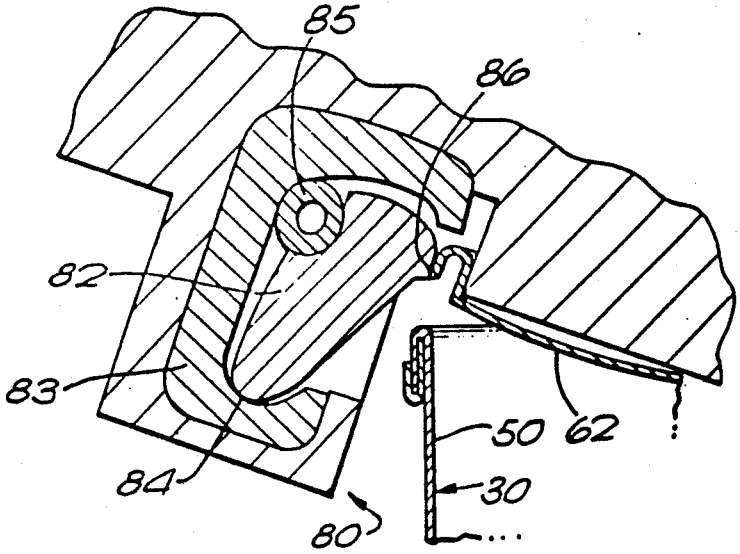
FIG. 10 is a detail similar to FIG. 9 showing the lid being removed.

This mechanism 80 is shown in more detail in FIGS. 9 and 10 and comprises a metal lever arm 82. This is mounted in an outer metal frame 83 and hinges about its lower end 84. It is resiliently urged outwardly by a resilient member 85 and has an integral hook 86. The latter corresponds in position to the position of the cutting edge 46. Therefore, when the mechanism 80 is placed over the rim of a can as shown in FIG. 9, the lever arm 82 is resiliently retracted until the hook 86 snaps into the cut made in the material of the lid 62 in the region 64. Now when the whole can opener is levered up, the hook 86 forces the severed portion of the lid off from the rest of the can to open it.

An advantage of a can opener according to the invention is apparent from FIG. 10 in that the exposed top edge of the can after opening is not sharp since it is not a cut edge but is in fact the turned or bent over top edge of the side wall 50 of the can.

Figure 12:
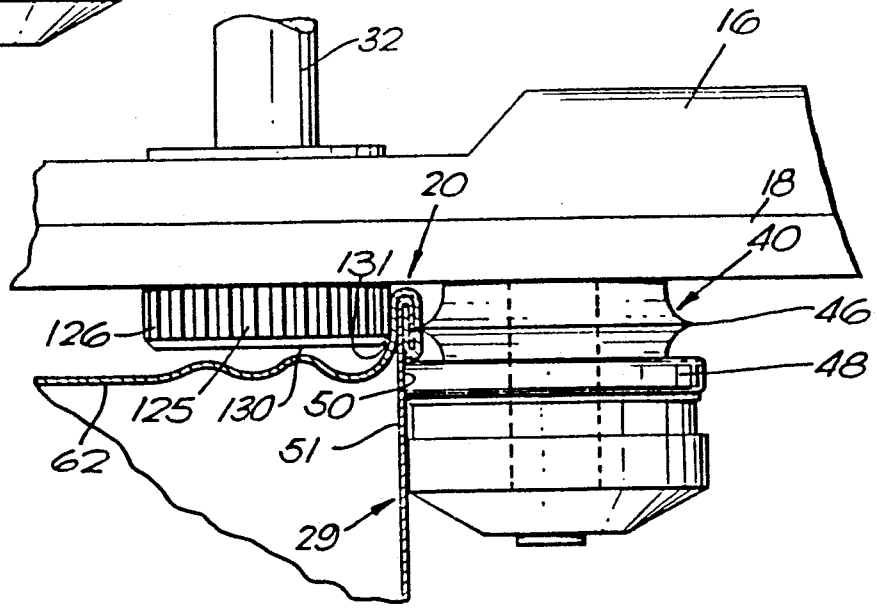
FIG. 12 is a view similar to FIG. 5 of that said another form of can opener.
Figure 11:
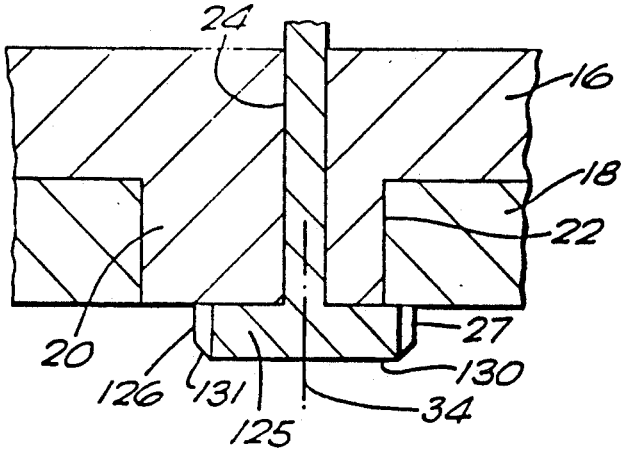
FIG. 11 is a view similar to FIG. 3 of another form of can opener according to the invention.

In the modified form of can opener shown in FIGS. 11 and 12 there is provided a modified drive wheel 125. Other parts of the can opener can be the same as described in connection with FIGS. 1 to 10 and similar parts are given similar reference numerals.

As shown in FIGS. 11 and 12, the lower edge 130, that is to say the edge which is adjacent to the lid of the can when in use, of the outer face 126 of the drive wheel 125 has a chamfer or bevel 131. This chamfer or bevel 131 is at an angle of about 45° and extends to a depth slightly greater than the serrations or teeth 27.

We have found that by providing this chamfer or bevel 131, the drive wheel 125 gives a better grip when cutting the small diameter corners of rectangular cans. It seems that a reason for this may be because the rim 28 in such corners is often not very upright but is angled outwardly so that, without the chamfer 31, only the lower edge of the face 126 of the wheel 125 would contact the rim so that the major portion of a serration or tooth does not contact the rim.

Figure 13:
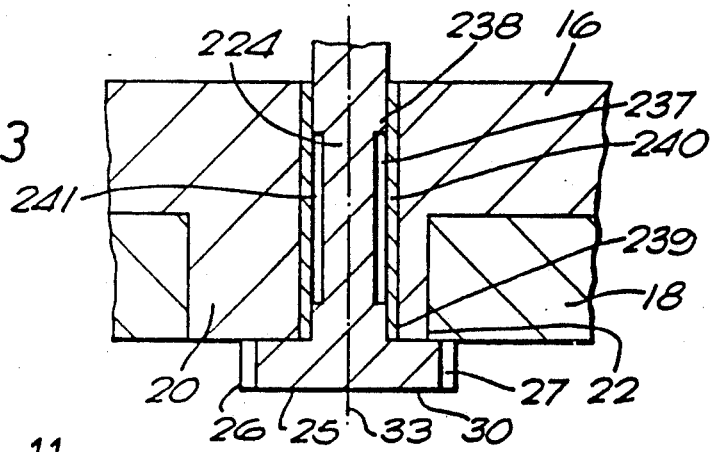
FIG. 13 is a view similar to FIG. 3 of yet another form of can opener according to the invention.

A detail of another modified form of can opener is shown in FIG. 13 where the drive spindle 224 differs from that shown in the embodiments of FIGS. 1 to 12. Other parts of the can opener can be the same as described in connection with either FIGS. 1 to 10 or FIGS. 11 and 12 and similar parts are given the same reference numerals as in FIGS. 1 to 10.

Referring to FIG. 13, the drive spindle 224 is rotatably journaled in a steel sleeve 237 embedded within the material of the spigot 20. At spaced regions 238 and 239 adjacent the ends of the sleeve 237, the spindle 224 has a diameter such that the spindle is a good mating fit within the sleeve. In this way good rotational support is provided for the spindle. In a central region 240, however, the spindle is of reduced diameter so as to leave a gap 241 between the spindle 224 and sleeve 237. This gap could, for example, be of a radial distance of around 0.4 mm because there is therefore no contact between the spindle and sleeve in this central region, there is therefore no friction created from the region during rotation of the shaft. Also a lubricating grease can be provided within the gap 241 for lubrication of the sliding surfaces in the regions 238 and 239. In these latter regions, however, there is a good mating fit between the interior of the sleeve and the exterior of the shaft so that good rotational support is given. Desirably the interior surface of the sleeve and exterior surface of the shaft have been hardened and tempered to HRC of 56 to reduce frictional forces.

I claim:

1. A can opener for opening a can having a lid joined to a main body by a rim, in which the can is opened by cutting through an outer part of the rim joining the lid with the main body of the can, in which the can opener comprises a rotatably supported cutter wheel for engaging and cutting the said outer part of the rim, a rotatable drive wheel for engaging the inner part of the rim, means for gripping the rim between the cutter wheel and drive wheel so that, upon rotation of the drive wheel, the can opener orbits around the rim of the can and the cutter wheel can compete a cut around the outer part of the rim, resilient means for allowing the cutter wheel to move resiliently in an axial direction along its axis of rotation, and cam means joined to the cutter wheel and axially spaced from the cutter wheel by a predetermined amount, the cam means being arranged to engage the underside of the rim, the engagement underneath the rim moving the cam means and the cutter wheel against the resilient means to a position such that the cutter wheel makes its cut at a substantially constant predetermined distance up the rim from its lower end.

2. A can opener as claimed in claim 1 in which the cam means comprise a circular flange having an upper face which is inclined relative a plane radial to the axis of the flange and is arranged to engage under the rim, the inclined upper face moving the circular flange and the associated cutter wheel against the resilient means as the flange is forced in beneath the rim when the rim is gripped between the cutter wheel and drive wheel and the cutting edge of the cutter wheel is forced to penetrate through the outer part of the rim.

3. A can opener as claimed in claim 2 in which the circular flange has a larger diameter than the cutter wheel, the difference in diameters being chosen to ensure that the cutting edge of the cutter wheel does not penetrate significantly beyond the material of the outer part of the rim.

4. A can opener as claimed in claim 1 in which the circular flange and cutter wheel are formed from a single piece of material.

5. A can opener as claimed in claim 1 in which the circular flange and cutter wheel are jointly mounted about a common axle on which they rotate.

6. A can opener as claimed in claim 1 in which the resilient means comprise a resilient rubber washer mounted between the cam means and a stationary support.

7. A can opener as claimed in claim 1 in which the drive wheel has an outer cylindrical surface which is serrated to allow it to grip into the material of the rim to assist in driving the can opener around the can, and the lower edge, that is to say the edge adjacent to the lid of the can when in use, of the outer cylindrical surface of the drive wheel is bevelled 8. A can opener as claimed in claim 7 in which the angle of the bevel is from 30° to 60° to the axis of the drive wheel.

9. A can opener as claimed in claim 7 or claim 8 in which the bevel extends radially inwardly at the lower edge of the drive wheel by an amount at least equal to the depth of the serrations.

10. A can opener as claimed in claim 7 in which the maximum radial depth of the serrations is no more than 1.5 mm.

11. A can opener as claimed in claim 10 in which the maximum radial depth of the serrations is no more than 1 mm.

12. A can opener as claimed in claim 1 in which the drive wheel is supported by a metal shaft which is rotatably journaled within a metal sleeve supported by the body of the can opener, the outer surface of the shaft and the inner surface of the sleeve mate at positions adjacent the ends of the sleeve so as to provide rotational support for the shaft and intermediate those positions a gap being provided between the outer surface of the shaft and the inner surface of the sleeve to avoid contact between the shaft and sleeve so as to reduce frictional forces upon rotation of the shaft relative the sleeve.

13. A can opener as claimed in claim 2 which comprises a cutter wheel for engaging and cutting the said outer part of the rim, a rotatable drive wheel for engaging the inner part of the rim, a pair of body members pivoted to one another and arranged, upon pivoting relative one another, to move the drive wheel and cutter wheel towards and away from one another respectively to allow the can opener to be fitted over the rim of a can to be opened and to grip the rim between the cutter wheel and drive wheel so that, upon rotation of the drive wheel, the can opener orbits around the rim of the can and the cutter wheel can complete a cut around the outer part of the rim, the cutter wheel being rotatably supported on a shaft upstanding from one of the body members, a circular flange of diameter greater than the cutter wheel also being supported on the said shaft, and an arcuate support wall upstanding from the said one body member and being centered on the axis of rotation of the cutter wheel, the circular flange being arranged to bear against the support wall to assist in supporting the shaft and cutter wheel during cutting of the rim of a can.

14. A can opener as claimed in claim 1 in which the can opener comprises a cutter wheel for engaging and cutting the said outer part of the rim, a rotatable drive wheel for engaging the inner part of the rim, a pair of body members pivoted to one another and having integral handles extending generally in a direction away from the point of pivoting, the body members being arranged, upon pivoting relative one another, to move the drive wheel and cutter wheel towards and away from one another respectively to allow the can opener to be fitted over the rim of a can to be opened and to grip the rim between the cutter wheel and drive wheel so that, upon rotation of the drive wheel, the can opener orbits around the rim of the can and the cutter wheel can complete a cut around the outer part of the rim, one body member supporting the cutter wheel and having a substantially flat surface in the region of the nip between the cutter wheel and the drive wheel, the integral handle of the other body member having an undersurface which is substantially flat and also substantially in the same plane as the substantially flat surface on the said one body member, whereby when the body members and their integral handles are pivoted to allow the can opener to be fitted over the rim of a can, those two surfaces will rest on the top of the rim of a can and will align the axis of the cutter wheel so that at least in the plane containing them it is parallel with the upright axis to the can.

15. A can opener for opening a can having a lid joined to a main body by a rim, in which the can is opened by cutting through an outer part of the rim joining the lid with the main body of the can, in which the can opener comprises a cutter wheel for engaging and cutting the said outer part of the rim, a rotatable drive wheel for engaging the inner part of the rim, a pair of body members pivoted to one another and having integral handles extending generally in a direction away from the axis of pivoting, the body members being arranged, upon pivoting relative one another, to move the drive wheel and cutter wheel towards and away from one another respectively to allow the can opener to be fitted over the rim of a can to be opened and to grip the rim between the cutter wheel and drive wheel so that, upon rotation of the drive wheel, the can opener orbits around the rim of the can and the cutter wheel can complete a cut around the outer part of the rim, one body member supporting the cutter wheel and having a substantially flat surface in the region of the nip between the cutter wheel and the drive wheel, the integral handle of the other body member having an undersurface which is substantially flat and also substantially in the same plane as the substantially flat surface on the said one body member, whereby when the body members and their integral handles are pivoted to allow the can opener to be fitted over the rim of a can, those two surfaces will rest on the top of the rim of a can and will align the axis of the cutter wheel so that at least in the plane containing them it is parallel with the upright axis to the can.

16. A can opener as claimed in claim 15 in which the said one body member which supports the cutter wheel also has a further contact surface on the opposite side of the drive wheel from the cutter wheel.

* * * * *

UNITED STATES PATENT AND TRADEMARK OFFICE

CERTIFICATE OF CORRECTION

PATENT NO. : 5,181,322

DATED : January 26, 1993

INVENTOR(S) : KOO, Vincent H.

It is certified that error appears in the above-identified patent and that said Letters Patent is hereby corrected as shown below:

On title page, item [73] after "Maxpat Trading & Marketing", delete

"(Far West)" and substitute therefor -- (Far East) --.

Signed and Sealed this

Sixteenth Day of November, 1993

Bruce Lehman

*Attest:*

BRUCE LEHMAN

*Attesting Officer*

*Commissioner of Patents and Trademarks*